US011404808B2

(12) United States Patent
Zheng et al.

(10) Patent No.: US 11,404,808 B2
(45) Date of Patent: Aug. 2, 2022

(54) COAXIAL CONNECTOR AND BOARD-TO-BOARD CONNECTOR ASSEMBLY

(71) Applicant: CommScope Technologies LLC, Hickory, NC (US)

(72) Inventors: Jien Zheng, Jiangsu (CN); JianPing Wu, Jiangsu (CN); Hongjuan An, Jiangsu (CN); Yuanyao Zhou, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/089,909

(22) Filed: Nov. 5, 2020

(65) Prior Publication Data

US 2021/0143568 A1 May 13, 2021

(30) Foreign Application Priority Data

Nov. 11, 2019 (CN) ..... 201911093995.X

(51) Int. Cl.
*H01R 13/631* (2006.01)
*H01R 12/71* (2011.01)
(Continued)

(52) U.S. Cl.
CPC ..... *H01R 12/716* (2013.01); *H01R 13/18* (2013.01); *H01R 24/50* (2013.01); *H01R 2103/00* (2013.01)

(58) Field of Classification Search
CPC ..... H01R 12/716; H01R 13/18; H01R 24/50; H01R 2103/00; H01R 12/73; H01R 12/58;
(Continued)

(56) References Cited

U.S. PATENT DOCUMENTS 4,580,862 A * 4/1986 Johnson ..... H01R 24/52 439/248
5,516,303 A * 5/1996 Yohn ..... H01R 13/6315 439/248
(Continued)

FOREIGN PATENT DOCUMENTS

KR 2019001860 A 4/2019

OTHER PUBLICATIONS

"International Search Report and Written Opinion corresponding to International Application No. PCT/US2020/059275 dated Feb. 26, 2021".
(Continued)

*Primary Examiner* — Abdullah A Riyami
*Assistant Examiner* — Nelson R. Burgos-Guntin
(74) *Attorney, Agent, or Firm* — Myers Bigel, P.A.

(57) ABSTRACT

A coaxial connector comprises an outer conductor, an inner conductor, and a dielectric spacer disposed between the outer conductor and the inner conductor. The outer conductor includes a first outer conductor component and a second outer conductor component configured to be floatable axially and radially relative to the first outer conductor component. The inner conductor includes a first inner conductor component and a second inner conductor component configured to be floatable axially and radially relative to the first inner conductor component. The coaxial connector further includes a first elastic element disposed around an outer circumference of the proximal portion of the second outer conductor component, and a second elastic element disposed in the cavity of the first inner conductor component. The coaxial connector is self-adaptive for the mating, and is particularly suitable for board-to-board connector assemblies and may ensure a high return loss performance and good PIM characteristics.

20 Claims, 5 Drawing Sheets

(51) Int. Cl.
*H01R 13/18* (2006.01)
*H01R 24/50* (2011.01)
*H01R 103/00* (2006.01)

(58) Field of Classification Search
CPC .... H01R 12/91; H01R 13/2421; H01R 24/38; H01R 13/6315; H01R 13/02
See application file for complete search history.

(56) References Cited

U.S. PATENT DOCUMENTS 5,980,290 A * 11/1999 Meynier ..... H01R 13/6315 439/246
6,224,390 B1 * 5/2001 Mitani ..... H01R 13/6315 439/63
6,699,054 B1 * 3/2004 Critelli ..... H01R 13/6315 439/248
6,776,668 B1 * 8/2004 Scyoc ..... H01R 13/2421 439/295
7,422,456 B1 * 9/2008 Mitani ..... H01R 13/6315 439/247
7,455,550 B1 * 11/2008 Sykes ..... H01R 13/506 439/578
7,922,529 B1 * 4/2011 Meurer ..... H01R 24/50 439/578
8,043,118 B1 * 10/2011 Lee ..... H01R 13/14 439/578
8,636,522 B2 * 1/2014 Sykes ..... H01R 24/44 439/63
9,559,441 B2 * 1/2017 Pari ..... H01R 13/64
9,735,531 B2 * 8/2017 Zhu ..... H01R 43/16
9,793,660 B2 * 10/2017 Holland ..... H01R 24/46
10,103,485 B2 * 10/2018 Ikeda ..... H01R 4/028
10,622,765 B2 * 4/2020 Song ..... H01R 24/50
10,790,624 B2 * 9/2020 Wang ..... H01R 24/50
10,804,635 B2 * 10/2020 Song ..... H01R 24/50
11,025,008 B2 * 6/2021 Kim ..... H01R 13/508
2002/0061670 A1 * 5/2002 Havener ..... H01R 24/50 439/246
2003/0060069 A1 3/2003 Duquerroy et al.
2008/0057782 A1 * 3/2008 Berthet ..... H01R 24/50 439/581
2011/0117778 A1 * 5/2011 Xie ..... H01R 24/44 439/578
2012/0142232 A1 * 6/2012 Yin ..... H01R 24/542 439/817
2012/0295478 A1 11/2012 Mrowka
2014/0030915 A1 * 1/2014 Perrin ..... H01R 24/50 439/578
2018/0034205 A1 * 2/2018 Ikeda ..... H01R 4/60
2018/0124921 A1 5/2018 Song et al.
2019/0165525 A1 * 5/2019 Gartmann ..... H01R 24/542
2019/0280439 A1 * 9/2019 Ni ..... H01R 13/2421
2020/0091639 A1 * 3/2020 Meynier ..... H01R 12/91
2020/0244018 A1 * 7/2020 Park ..... H01R 12/91
2021/0083415 A1 * 3/2021 Huang ..... H01R 13/6315
2021/0143568 A1 * 5/2021 Zheng ..... H01R 12/716
2021/0143581 A1 * 5/2021 Wu ..... H01R 24/50

OTHER PUBLICATIONS

"International Preliminary Report on Patentability corresponding to International Application No. PCT/US2020/059275 dated May 27, 2022".

* cited by examiner

COAXIAL CONNECTOR AND BOARD-TO-BOARD CONNECTOR ASSEMBLY

RELATED APPLICATION

The present application claims priority from and the benefit of Chinese Application No. 201911093995.X, filed Nov. 11, 2019, the disclosure of which is hereby incorporated herein by reference in its entirety.

FIELD OF INVENTION

The present disclosure relates generally to cable connectors. More particularly, the present disclosure relates to self-adaptive coaxial connectors and board-to-board connector assemblies including the same.

BACKGROUND OF INVENTION

Coaxial cables are commonly utilized in radio frequency (RF) communications systems. Coaxial cable connectors may be applied to terminate coaxial cables, for example, in communication systems requiring a high level of precision and reliability.

The coaxial connector interfaces provide a connect/disconnect functionality between (a) a cable terminated with a connector bearing the desired connector interface and (b) a corresponding connector with a mating connector interface mounted on an electronic device or another cable.

In some cases, the coaxial connector interfaces may be configured with a blind-mating characteristic to enable push-on interconnection. Such blind-mating coaxial connector interfaces are particularly suitable for board-to-board connector assemblies, in which a plurality of coaxial connector interfaces are mounted on two printed circuit boards that are generally disposed parallel to one another respectively.

However, in the blind-mating coaxial connector interfaces, especially in the board-to-board connector assemblies equipped with a plurality of blind-mating coaxial connector interfaces, the interconnect portions of the coaxial connector interfaces may be difficult to align accurately due to inconsistent processing and/or mounting precision of the coaxial connector interfaces and/or deformation of the printed circuit boards in use, which may have a negative effect on the return loss performance and PIM characteristics of the connectors. Therefore, there is still room for improvement in the blind-mating coaxial connector interfaces.

SUMMARY OF THE INVENTION

One of objects of the present disclosure is to provide a coaxial connector and a board-to-board connector assembly including the same that can overcome at least one of drawbacks in the prior art.

In the first aspect of the present disclosure, a coaxial connector is provided. The coaxial connector comprises an outer conductor, an inner conductor, and a dielectric spacer disposed between the outer conductor and the inner conductor; wherein the outer conductor includes a first outer conductor component and a second outer conductor component configured to be floatable axially and radially relative to the first outer conductor component; and wherein the inner conductor includes a first inner conductor component and a second inner conductor component configured to be floatable axially and radially relative to the first inner conductor component.

According to an embodiment of the present disclosure, each of the first outer conductor component and the second outer conductor component is configured in a cylindrical shape and includes a proximal portion and a distal portion, wherein the distal portion of the first outer conductor component is configured to be inserted into the proximal portion of the second outer conductor component.

According to an embodiment of the present disclosure, an outer circumferential surface of the distal portion of the first outer conductor component includes a first protrusion protruding radially outwardly and being close to a distal end of the first outer conductor component, wherein when the distal portion of the first outer conductor component is inserted into the proximal portion of the second outer conductor component, the first protrusion abuts against an inner circumferential surface of the second outer conductor component, so as to form an electrical connection between the first outer conductor component and the second outer conductor component.

According to an embodiment of the present disclosure, the outer circumferential surface of the distal portion of the first outer conductor component further includes a second protrusion protruding radially outwardly and being axially spaced apart from the first protrusion by a distance; and an inner circumferential surface of the proximal portion of the second outer conductor component includes a third protrusion projecting radially inwardly and being close to a proximal end portion of the second outer conductor component, wherein when the distal portion of the first outer conductor component is inserted into the proximal portion of the second outer conductor component, the second protrusion passes over the third protrusion, so as to form a mechanical connection between the first outer conductor component and the second outer conductor component by means of an interference fit between the second protrusion and the third protrusion to ensure the first outer conductor component will not disconnect from the second outer conductor component.

According to an embodiment of the present disclosure, the distal portion of the first outer conductor component includes a plurality of resilient fingers spaced apart from each other, wherein the first protrusion is disposed on the resilient fingers.

According to an embodiment of the present disclosure, the distal portion of the first outer conductor component includes a plurality of resilient fingers spaced apart from one another, wherein the first protrusion and the second protrusion are both disposed on the resilient fingers.

According to an embodiment of the present disclosure, when the distal portion of the first outer conductor component is inserted into the proximal portion of the second outer conductor component, a gap is present between the second protrusion and the inner circumferential surface of the proximal portion of the second outer conductor component.

According to an embodiment of the present disclosure, each of the first protrusion, the second protrusion, and the third protrusion has an arc-shaped outer surface.

According to an embodiment of the present disclosure, the coaxial connector further comprises a first elastic element disposed at least around an outer circumference of the proximal portion of the second outer conductor component, wherein in an initial state, the first elastic element spaces the first outer conductor component from the second outer conductor component at a predetermined distance, and in a compressed state, the first elastic element is capable of being compressed to allow the second outer conductor component to float axially relative to the first outer conductor component.

According to an embodiment of the present disclosure, the proximal portion of the first outer conductor component is provided with a first step portion, the distal portion of the second outer conductor component is provided with a second step portion, and the first elastic element is received in a recess formed by the first step portion and the second step portion.

According to an embodiment of the present disclosure, the first elastic element is a coil spring.

According to an embodiment of the present disclosure, the second step portion includes a tapered outer circumferential surface to facilitate the second outer conductor component to be pushed.

According to an embodiment of the present disclosure, the second step portion includes an arc-shaped outer circumferential surface to facilitate the second outer conductor component to be pushed.

According to an embodiment of the present disclosure, the first inner conductor component is configured as an elongated element, and the second inner conductor component is configured to be fittable over an outer circumference of a distal portion of the first inner conductor component.

According to an embodiment of the present disclosure, the second inner conductor component includes a central body, and a first cylindrical portion and a second cylindrical portion extending axially from the central body towards a proximal side and a distal side respectively, wherein the first cylindrical portion is fittable over the outer circumference of the distal portion of the first inner conductor component, and the second cylindrical portion is adapted for mating with an inner conductor of a mating connector.

According to an embodiment of the present disclosure, when the first cylindrical portion is fitted over the outer circumference of the distal portion of the first inner conductor component, a gap is present between the first cylindrical portion and the outer circumference of the distal portion of the first inner conductor component, so as to allow the second inner conductor component to float axially and radially relative to the first inner conductor component.

According to an embodiment of the present disclosure, the first inner conductor component and the second inner conductor component are connected to each other by means of a connecting element, wherein the connecting element is configured as an elongated element and includes a proximal portion and a distal portion, the proximal portion of the connecting element is slidably connected to the distal portion of the first inner conductor component, and the distal portion of the connecting element is fixed to the central body of the second inner conductor component.

According to an embodiment of the present disclosure, the distal portion of the connecting element is fixed to the central body of the second inner conductor component by means of press-fitting.

According to an embodiment of the present disclosure, the distal portion of the first inner conductor component includes a cavity that opens toward a distal end of the first inner conductor component, and the proximal portion of the connecting element is slidably received in the cavity.

According to an embodiment of the present disclosure, the proximal portion of the connecting element is slidably received in the cavity by means of a stop element.

According to an embodiment of the present disclosure, the stop element is fixed to the distal end of the first inner conductor part in a press-fit manner.

According to an embodiment of the present disclosure, a second elastic element is provided in the cavity, wherein in an initial state, the second elastic element spaces the first inner conductor component from the second inner conductor component at a predetermined distance, and in a compressed state, the second elastic element is capable of being compressed to allow the second inner conductor component to float axially relative to the first inner conductor component.

According to an embodiment of the present disclosure, the second elastic element is a coil spring.

According to an embodiment of the present disclosure, each of the first cylindrical portion and the second cylindrical portion is provided with slots to form a plurality of first resilient fingers and a plurality of second resilient fingers respectively.

In the second aspect of the present disclosure, a board-to-board connector assembly is provided. The board-to-board connector assembly comprises: a first printed circuit board and a second printed circuit board disposed substantially parallel to each other; at least one first coaxial connector mounted to the first printed circuit board, wherein the first coaxial connector is configured as the coaxial connector according to the present disclosure; and at least one second coaxial connector mounted to the second printed circuit board, wherein the second coaxial connector is capable of mating with the first coaxial connector.

According to an embodiment of the present disclosure, the second coaxial connector includes an outer conductor, an inner conductor, and a dielectric spacer disposed between the outer conductor and the inner conductor of the second coaxial connector, wherein the outer conductor of the second coaxial connector has a cylindrical shape, and a proximal portion of the outer conductor of the second coaxial connector includes a tapered inner circumferential surface.

According to an embodiment of the present disclosure, the board-to-board connector assembly includes a plurality of first coaxial connectors and a plurality of second coaxial connectors, wherein the plurality of first coaxial connectors and the plurality of second coaxial connectors are disposed on the first printed circuit board and the second printed circuit board respectively in a same array.

BRIEF DESCRIPTION OF THE DRAWINGS

After reading the embodiments described below in combination with the drawings, a plurality of aspects of the present disclosure will be better understood. In the drawings.

DESCRIPTION OF THE EMBODIMENTS

Figure 1:
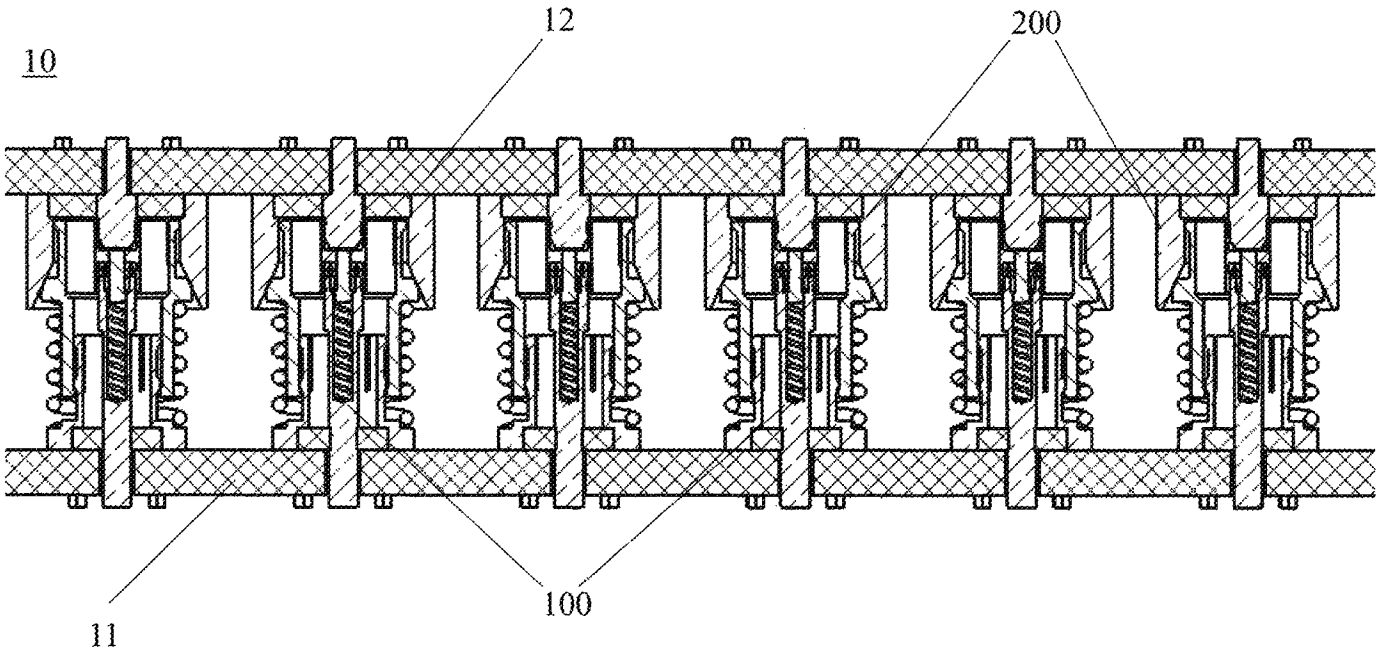
FIG. 1 is a cross-sectional view of a board-to-board connector assembly according to an embodiment of the present disclosure.

The present disclosure will be described below with reference to the drawings, in which several embodiments of the present disclosure are shown. It should be understood, however, that the present disclosure may be implemented in many different ways and may not be limited to the example embodiments described below. In fact, the embodiments described hereinafter are intended to make a more complete disclosure of the present disclosure and to adequately explain the protection scope of the present disclosure to a person skilled in the art. It should also be understood that the embodiments disclosed herein can be combined in various ways to provide many additional embodiments.

It should be understood that, in all the drawings, the same reference signs present the same elements. In the drawings, for the sake of clarity, the sizes of certain features may be modified.

It should be understood that the wording in the specification is only used for describing particular embodiments and is not intended to limit the present disclosure. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The words "comprising", "containing" and "including" used in the specification indicate the presence of the claimed features, but do not preclude the presence of one or more additional features. The wording "and/or" as used in the specification includes any and all combinations of one or more of the relevant items listed.

The terms "first" and "second" are used in the specification for ease of description and are not intended to be limiting. Any technical features represented by the terms "first" and "second" are interchangeable.

The letters "P" and "D" used in the drawings indicate "proximal" and "distal" directions respectively. Unless expressly stated otherwise, phrases referring to a "proximal" end or "proximal" side of an element may be deemed to refer to a portion that is closer to P than other portions of the same element. Likewise, unless expressly stated otherwise, phrases referring to a "distal" end or "distal" side of an element may be deemed to refer to a portion that is closer to D than other portions of the same element.

Referring now to the drawings, FIG. 1 shows a board-to-board connector assembly 10 according to an embodiment of the present disclosure. The board-to-board connector assembly 10 may include a first printed circuit board 11, a second printed circuit board 12, at least one first coaxial connector 100 mounted to the first printed circuit board 11, and at least one second coaxial connector 200 mounted to the second printed circuit board 12. The first coaxial connector 100 is capable of mating with the second coaxial connector 200. In the case where the board-to-board connector assembly 10 includes a plurality of first coaxial connectors 100 and a plurality of second coaxial connectors 200, the plurality of first coaxial connectors 100 and the plurality of second coaxial connectors 200 may be disposed on the first printed circuit board 11 and the second printed circuit board 12, respectively, in a same array.

The first printed circuit board 11 and the second printed circuit board 12 may be of conventional construction, and may include conductive traces, vias, and electronic components for transmitting electrical signals. In use, the first printed circuit board 11 and the second printed circuit board 12 are generally disposed parallel to each other. The first printed circuit board 11 may be mounted on a piece of communication device, such as a base station antenna, and the second printed circuit board 12 may be mounted on a separate piece of communication device, such as a remote radio unit (RRU).

Figure 2:
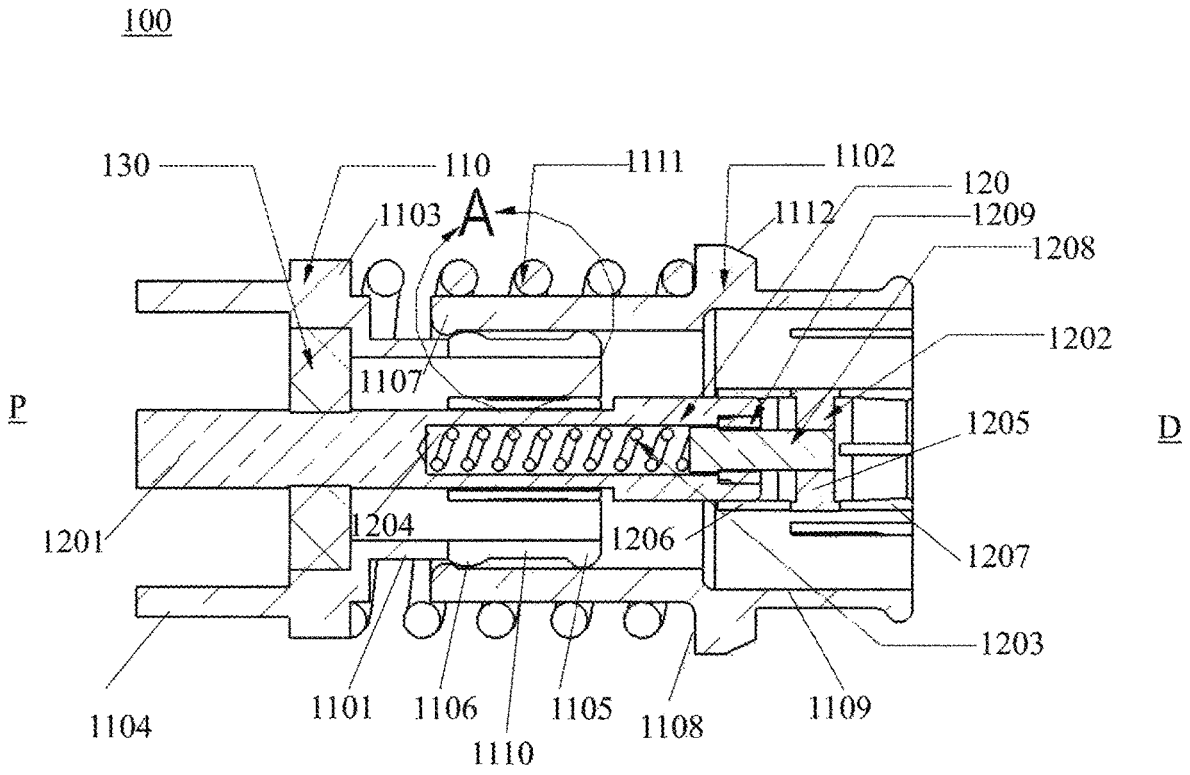
FIG. 2 is a cross-sectional view of a first coaxial connector according to an embodiment of the present disclosure.
Figure 3:
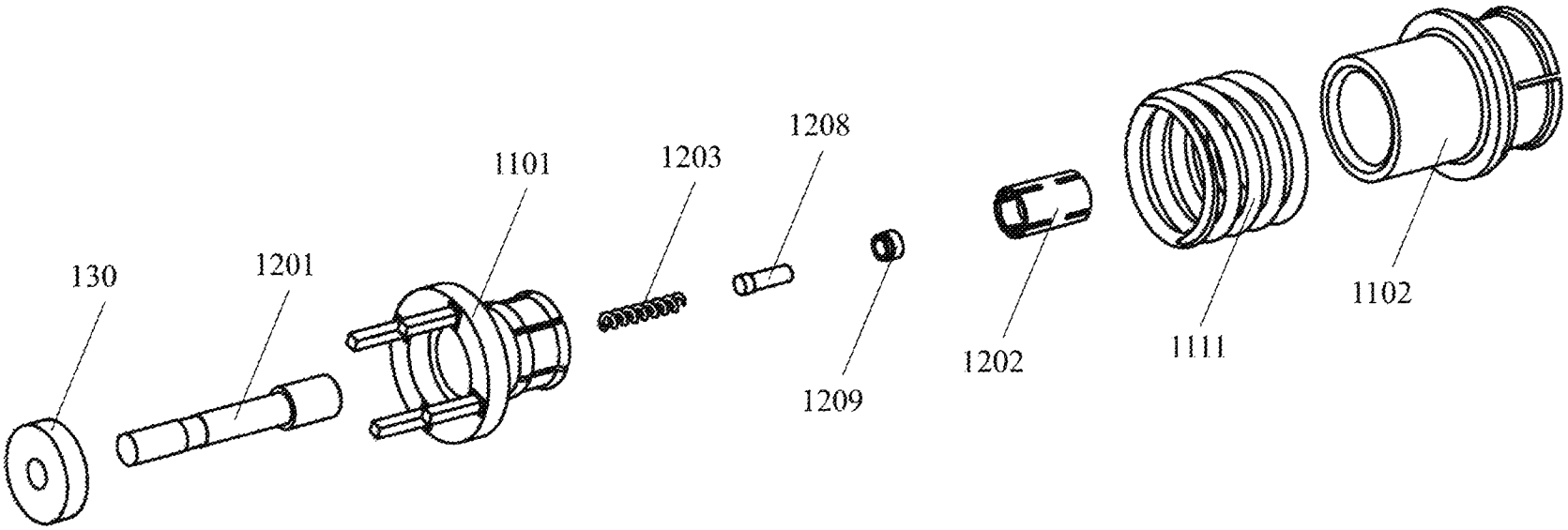
FIG. 3 is an exploded perspective view of the first coaxial connector of FIG. 2.

Referring to FIGS. 2 and 3, a specific structure of the first coaxial connector 100 according to one embodiment of the present disclosure is illustrated. The first coaxial connector 100 may be constructed as a female connector, and may include an outer conductor 110, an inner conductor 120, and a dielectric spacer 130 disposed between the outer conductor 110 and the inner conductor 120 and spacing them from each other.

The outer conductor 110 and the inner conductor 120 of the first coaxial connector 100 may each be configured as a split-type structure. The outer conductor 110 may include a first outer conductor component 1101 and a second outer conductor component 1102, and the second outer conductor component 1102 is floatable axially and radially with respect to the first outer conductor component 1101. The inner conductor 120 may include a first inner conductor component 1201 and a second inner conductor component 1202, and the second inner conductor component 1202 is floatable axially and radially with respect to the first inner conductor component 1201.

In the present disclosure, the term "floatable" may refer to "movable linearly" as well as "tiltable or deflectable". For example, "floatable axially" may refer to "movable linearly in an axial direction", and "floatable radially" may refer to "tiltable or deflectable in a radial direction".

Since the second outer conductor component 1102 is floatable axially with respect to the first outer conductor component 1101 and the second inner conductor component 1202 is floatable axially with respect to the first inner conductor component 1201, the length of the first coaxial connector 100 can be adjusted, which makes the first coaxial connector 100 applicable between two printed circuit boards spaced apart from each other at different intervals. Since the second outer conductor component 1102 is floatable radially with respect to the first outer conductor component 1101 and the second inner conductor component 1202 is floatable radially with respect to the first inner conductor component 1201, the first coaxial connector 100 can adjust to the position of the second coaxial connector 200 and therefore may blind-mate with the second coaxial connector 200 smoothly and may be maintained in a good working condition even in case that the printed circuit boards are deformed, or the first coaxial connector 100 and the second coaxial connector 200 are not mounted on the printed circuit boards precisely.

The specific structure of the outer conductor 110 will be described firstly. As described above, the outer conductor 110 may include a first outer conductor component 1101 and a second outer conductor component 1102. In the embodiment shown in FIG. 2, the first outer conductor component 1101 may have a generally cylindrical shape and includes a proximal portion and a distal portion. The proximal portion of the first outer conductor component 1101 is provided with a step portion 1103 and at least one pin 1104 extending axially from an end surface of the step portion 1103 towards the proximal side P (in the embodiment shown in FIG. 3, there are four pins, but there may also be two, three or another number of pins). By means of pins 1104, the first outer conductor component 1101 may be welded to the first printed circuit board 11. An outer circumferential surface of the distal portion of the first outer conductor component 1101 is provided with protrusions 1105 and 1106 that protrude radially outwardly. The protrusions 1105 and 1106 may be annular protrusions that extend along the outer circumferential surface of the first outer conductor component 1101. The protrusions 1105 and 1106 may have an arc-shaped outer surface. The protrusions 1105 and 1106 are axially spaced apart by a distance, wherein the protrusion 1105 is closer to a distal end of the first outer conductor component 1101 than the protrusion 1106.

The second outer conductor component 1102 may also have a generally cylindrical shape and includes a proximal portion and a distal portion. An inner circumferential surface of the proximal portion of the second outer conductor component 1102 is provided with a protrusion 1107 that protrudes radially inwardly, and the protrusion 1107 is close to a proximal end of the second outer conductor component 1102. The protrusion 1107 may be an annular protrusion extending along the inner circumferential surface of the second outer conductor component 1102. The protrusion 1107 may have an arc-shaped outer surface. The distal portion of the second outer conductor component 1102 is provided with a step portion 1108 and a plurality of resilient fingers 1109 extending axially from an end surface of the step portion 1108 towards a distal side D. The resilient fingers 1109 are adapted to mate with an outer conductor of the second coaxial connector 200.

The distal portion of the first outer conductor component 1101 is configured to be insertable into the proximal portion of the second outer conductor component 1102. When the distal portion of the first outer conductor component 1101 is inserted into the proximal portion of the second outer conductor component 1102, the protrusion 1105 of the first outer conductor component 1101 abuts against the inner circumferential surface of the second outer conductor component 1102 to form an electrical connection between the first outer conductor component 1101 and the second outer conductor component 1102 and to ensure good passive intermodulation (PIM) characteristics therebetween; and meanwhile, the protrusion 1106 of the first outer conductor component 1101 may pass over the protrusion 1107 of the second outer conductor component 1102 and thus be inserted into the proximal portion of the second outer conductor component 1102, so as to form a mechanical connection between the first outer conductor component 1101 and the second outer conductor component 1102 by means of an interference-fit between the protrusions 1106 and 1107 to ensure that the first outer conductor component 1101 will not disconnect from the second outer conductor component 1102.

Figure 4:
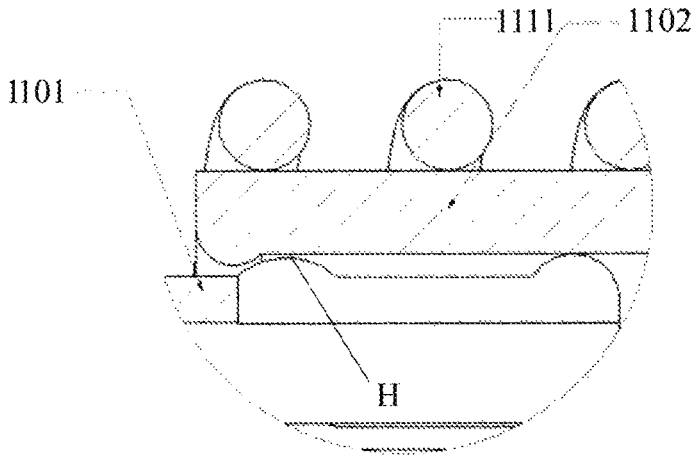
FIG. 4 is a partial enlarged view of a portion A of the first coaxial connector of FIG. 2.

In order to reduce the fitting pressure required for insertion of the distal portion of the first outer conductor component 1101 into the proximal portion of the second outer conductor component 1102 and allow the second outer conductor component 1102 to be floatable radially at a certain angle with respect to the first outer conductor component 1101, the distal portion of the first outer conductor component 1101 may be configured to include a plurality of resilient fingers 1110 spaced apart from one another. The resilient fingers 1110 are deformable radially. At least the protrusion 1105 may be disposed on the resilient fingers 1110. In addition, in order to further reduce the fitting pressure required for insertion of the distal portion of the first outer conductor component 1101 into the proximal portion of the second outer conductor component 1102 and promote the radial floating of the second outer conductor component 1102 with respect to the first outer conductor component 1101, the height of the protrusion 1106 of the first outer conductor component 1101 may be designed such that a gap H is formed between the protrusion 1106 and the inner circumferential surface of the second outer conductor component 1102 (as shown in FIG. 4).

In order to enable the second outer conductor component 1102 to float axially in a distance with respect to the first outer conductor component 1101, a first elastic element 1111 is provided. The first elastic element 1111 may be disposed at least around an outer circumference of the proximal portion of the second outer conductor component 1102 and received in a recess formed by the step portion 1103 of the first outer conductor component 1101 and the step portion 1108 of the second outer conductor component 1102. The first elastic element 111 is deformable axially (compressive deformation) and radially (bending deformation). In the initial state, the first elastic element 1111 may space the proximal end surface of the second outer conductor component 1102 from the step portion 1103 of the first outer conductor component 1101 by a predetermined distance, and may keep the second outer conductor component 1102 and the first outer conductor component 1101 as coaxial as possible. In the compressed state, the first elastic element 1111 may be compressed by the pushing of the step portion 1108 of the second outer conductor component 1102, allowing the proximal end surface of the second outer conductor component 1102 to approach or abut against the step portion 1103 of the first outer conductor component 1101 to thereby adjust the length of the outer conductor 110. Further, when the second outer conductor component 1102 floats radially relative to the first outer conductor component 1101, the first elastic element 1111, subjected to bending deformation in the radial direction, may generate a restoring force. This restoring force is helpful for the second outer conductor component 1102 to arise a tendency of returning to the state that the second outer connector component 1102 is coaxial with the first outer conductor component 1101, so that the outer conductor 110 of the first coaxial connector 100 and the outer conductor 210 of the second coaxial connector 200 can be maintained in a good state of contact, which can thus ensure a high return loss performance and good PIM characteristics between the first coaxial connector 100 and the second coaxial connector 200.

Next, the specific structure of the inner conductor 120 will be described. As described above, the inner conductor 120 may include a first inner conductor component 1201 and a second inner conductor component 1202. The first inner conductor component 1201 is configured as an elongated element. A distal portion of the first inner conductor component 1201 is provided with a cavity 1204 for receiving a second elastic element 1203. The cavity 1204 is open toward a distal end of the first inner conductor component 1201. The second inner conductor component 1202 may include a central body 1205, and a first cylindrical portion 1206 and a second cylindrical portion 1207 extending axially from the central body 1205 towards the proximal side P and the distal side D respectively. The first cylindrical portion 1206 may be fitted over an outer circumference of the distal portion of the first inner conductor component 1201, while the second cylindrical portion 1207 may be adapted to mate with an inner conductor of the second coaxial connector 200. In order to facilitate the first cylindrical portion 1206 to be fitted over the outer circumference of the distal portion of the first inner conductor component 1201 and facilitate the second cylindrical portion 1207 to mate with the inner conductor of the second coaxial connector 200, the first cylindrical portion 1206 and the second cylindrical portion 1207 may each be provided with slots to form a plurality of first resilient fingers and a plurality of second resilient fingers, respectively.

The first inner conductor component 1201 and the second inner conductor component 1202 are connected to each other by means of a connecting element 1208. The connecting element 1208 may be configured as an elongated element such as a pin or a post, and includes a proximal portion and a distal portion. The proximal portion of the connecting element 1208 is provided with a step portion, by means of which the proximal portion of the connecting element 1208 may be stopped within the cavity 1204 of the first inner conductor component 1201 by a stop element 1209. The stop element 1209 may be fixed to the distal end of the first inner conductor component 1201 in a press-fit manner, such that the proximal portion of the connecting element 1208 is slidably movable within the cavity 1204 of the first inner conductor component 1201 but may not move out of the cavity 1204. The distal portion of the connecting element 1208 may be fixed to the central body 1205 of the second inner conductor component 1202. For example, the distal portion of the connecting element 1208 may be press fit into a hole provided in the central body 1205 of the second inner conductor component 1202. Of course, the present disclosure is not limited thereto. The stop element 1209 may be fixed to the distal end of the first inner conductor component 1201 in other suitable manners (for example, welding, threaded-connecting, etc.), and the distal portion of the connecting element 1208 may be fixed to the central body 1205 of the second inner conductor component 1202 in other suitable ways (for example, welding, threaded-connecting, etc.).

In order to enable the second inner conductor component 1202 to float radially at an angle with respect to the first inner conductor component 1201, an inner diameter of the first cylindrical portion 1207 of the second inner conductor component 1202 may be configured to be slightly larger than an outer diameter of the distal portion of the first inner conductor component 1201, and an outer diameter of the step portion of the connecting element 1208 may be configured to be slightly smaller than an inner diameter of the cavity 1204 of the first inner conductor component 1201. In this way, when the first inner conductor component 1201 and the second inner conductor component 1202 are connected together, a gap is present between the first cylindrical portion 1207 of the second inner conductor component 1201 and the outer circumference of the distal portion of the first inner conductor component 1201, and a gap is present between the connecting element 1208 and an inner surface of the cavity 1204 of the first inner conductor component 1201, allowing the second inner conductor component 1202 to be floatable radially with respect to the first inner conductor component 1201.

In order to enable the second inner conductor component 1202 to float axially in a distance relative to the first inner conductor component 1201, a second elastic element 1203 is provided in the cavity 1204 of the first inner conductor component 1201. The second elastic element 1203 is deformable axially (compressive deformation) and radially (bending deformation). In the initial state, the second elastic element 1203 may abut against the proximal end surface of the connecting element 1208 so as to maintain the second inner conductor component 1202 in an initial position with respect to the first inner conductor component 1201, and may keep the second inner conductor component 1202 and the first inner conductor component 1201 as coaxially as possible. In the compressed state, the second elastic element 1203 may be compressed by the pushing of the connecting element 1208, thereby allowing the second inner conductor component 1202 to be floatable axially in a distance relative to the first inner conductor component 1201 to thereby adjust the length of the inner conductor 120. Further, when the second inner conductor component 1202 floats radially relative to the first inner conductor component 1201, the second elastic element 1203, stressed unevenly in the radial direction, may generate a corresponding restoring force. This restoring force is helpful for the second inner conductor component 1202 to tend to return to the state in which the second inner connector component 1202 is coaxial with the first inner conductor component 1201, so that the inner conductor 120 of the first coaxial connector 100 and the inner conductor 220 of the second coaxial connector 200 can be maintained in a good state of contact, which thus ensures a high return loss performance and good PIM characteristics between the first coaxial connector 100 and the second coaxial connector 200.

It is to be noted that when the first coaxial connector 100 and the second coaxial connector 200 according to the present disclosure are mated with each other, the extent to which the second outer conductor component 1102 floats axially and radially with respect to the first outer conductor component 1101 may be different from the extent to which the second inner conductor component 1202 floats axially and radially relative to the first inner conductor component 1201, making the first coaxial connector 100 according to the present disclosure more flexible and adaptive.

Figure 5:
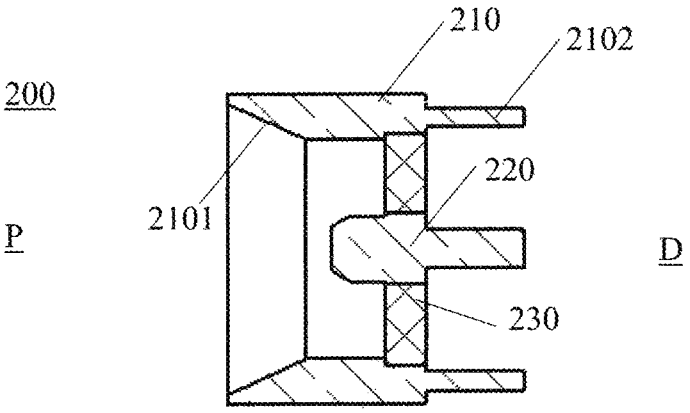
FIG. 5 is a cross-sectional view of a second coaxial connector according to an embodiment of the present disclosure.
Figure 6:
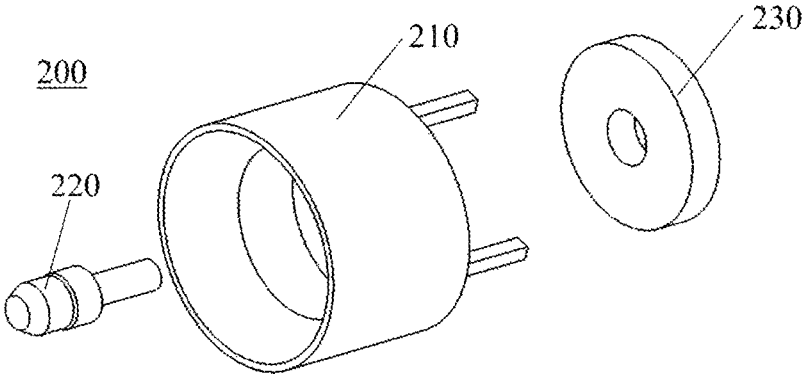
FIG. 6 is an exploded perspective view of the second coaxial connector of FIG. 5.

Referring to FIGS. 5 and 6, a specific structure of the second coaxial connector 200 according to one embodiment of the present disclosure is illustrated. The second coaxial connector 200 may be constructed as a male connector, and may include an outer conductor 210, an inner conductor 220, and a dielectric spacer 230 disposed between the outer conductor 210 and the inner conductor 220 and spacing them from each other. The outer conductor 210 may have a generally cylindrical shape. A proximal portion of the outer conductor 210 may include a tapered inner circumferential surface 2101 to facilitate the insertion of the outer conductor 110 of the first coaxial connector 100. A distal portion of the outer conductor 210 may include at least one pin 2102 extending axially toward the distal side D (in the embodiment shown in FIG. 6, there are two pins, but there may also be three, four or other number of the pins). By means of pins 2102, the outer conductor 210 may be welded to the second printed circuit board 12. The inner conductor 220 may be in the form of a pin or a post for insertion into the inner conductor 120 of the first coaxial connector 100.

Upon blind mating of the first coaxial connector 100 with the second coaxial connector 200, the tapered inner circumferential surface 2101 of the outer conductor 210 of the second coaxial connector 200 may also be used to press the second outer conductor component 1102 of the outer conductor 110 of the first coaxial connector 100, so as to adjust the length of the outer conductor 110 of the first coaxial connector 100 to make the first coaxial connector 100 adjustable between two printed circuit boards spaced from each other at different intervals. In order to facilitate the inner circumferential surface 2101 to press the outer conductor 110 of the first coaxial connector 100, the step portion 1108 of the second outer conductor component 1102 of the outer conductor 110 may include a tapered outer circumferential surface 1112. The outer circumferential surface 1112 may have the same taper as the inner circumferential surface 2101, so that the inner circumferential surface 2101 presses the second outer conductor component 1102 of the outer conductor 110 in a manner of surface-contacting the outer circumferential surface 1112. In another embodiment according to the present disclosure, the outer circumferential surface 1112 of the step portion 1108 may be arc-shaped, so that the inner circumferential surface 2101 of any taper is able to press the second outer conductor component 1102 of the outer conductor 110 by means of the outer circumferential surface 1112, thereby making the first coaxial connector 100 more adaptive.

Figure 7B:
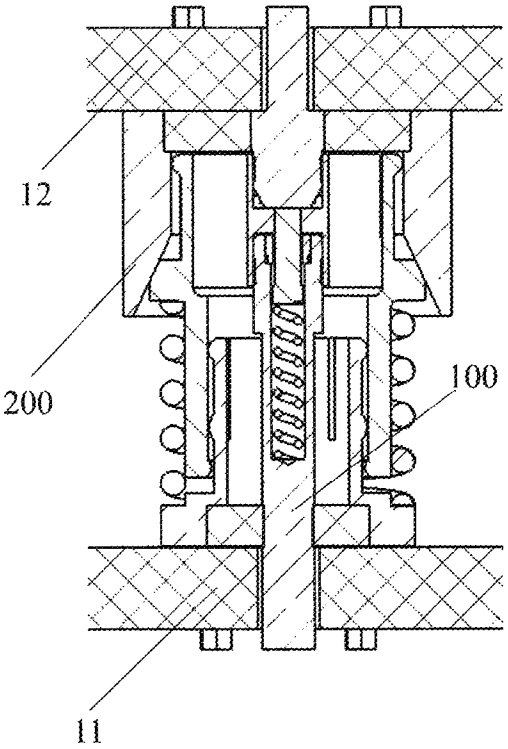
FIGS. 7*a* and 7*b* illustrate the application of the first and second coaxial connectors according to the present disclosure between two printed circuit boards spaced from each other at different intervals.
Figure 7A:
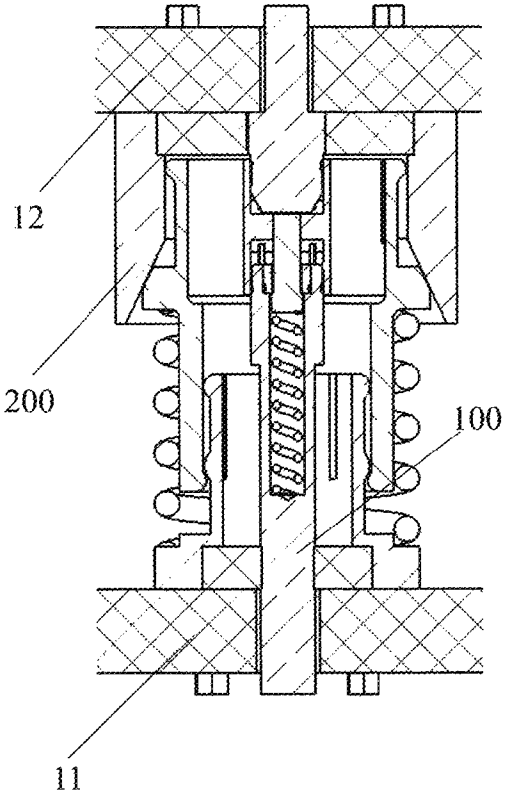

Referring to FIGS. 7*a* and 7*b*, the application of the first and second coaxial connectors according to the present disclosure between two printed circuit boards spaced apart from each other at different intervals is illustrated. In the embodiment shown in FIG. 7*a*, the first coaxial connector 100 is substantially in its initial state where the first elastic element 1111 and the second elastic element 1203 are substantially uncompressed. As a result, both the outer conductor 110 and the inner conductor 120 of the first coaxial connector 100 are maintained at their initial lengths. In the embodiment shown in FIG. 7*b*, as the first printed circuit board 11 and the second printed circuit board 12 are spaced apart from each other at a small interval, the first coaxial connector 100 is in its compressed state where the outer conductor 110 and the inner conductor 120 of the first coaxial connector 100 are both somewhat shortened, making the first coaxial connector 100 applicable between the first and second printed circuit boards with a small interval.

In embodiments according to the present disclosure, regardless of whether the first elastic element 1111 and the second elastic element 1203 of the first coaxial connector 100 are compressed by the second coaxial connector 200 or not, they may each be configured to apply an axial and/or radial force to the outer conductor 110 and the inner conductor 120 of the first coaxial connector 100, respectively. By means of the axial and/or radial forces exerted by the first elastic element 1111 and the second elastic element 1203, regardless of whether the first printed circuit board and/or the second printed circuit board are deformed or not, and whether the first coaxial connector 100 and the second coaxial connector 200 are aligned with each other or not, good contact between the first coaxial connector 100 and the second coaxial connector 200 can be ensured, thereby reducing or minimizing the deterioration of return loss performance and guaranteeing good dynamic PIM characteristics.

In embodiments according to the present disclosure, the first elastic element 1111 may be configured as a coil spring. The second elastic element 1203 may also be configured as a coil spring. However, the present disclosure is not limited thereto, and the first elastic element 1111 and the second elastic element 1203 may be configured as springs or elastic elements in other suitable forms. The first elastic element 1111 and the second elastic element 1203 may be made of a common material such as steel.

In embodiments according to the present disclosure, the outer conductor 110 and the inner conductor 120 of the first coaxial connector 100 and the outer conductor 210 and the inner conductor 220 of the second coaxial connector 200 may each be made of beryllium copper.

In embodiments according to the present disclosure, the first coaxial connector 100 and the second coaxial connector 200 may comprise various types of connector interfaces, such as a 4.3-10 female connector interface, a 2.2-5 connector interface, a DIN connector interface, a NEX 10 connector interface, an SMA connector interface, an N-type connector interface, a 7/16 radio frequency connector interface, and the like.

Although exemplary embodiments of this disclosure have been described, those skilled in the art should appreciate that many variations and modifications to the exemplary embodiments are possible without departing from the spirit and scope of the present disclosure. Accordingly, all such variations and modifications are intended to be included within the scope of this disclosure as defined in the claims.

What is claimed is:

1. A coaxial connector, characterized in that the coaxial connector comprises an outer conductor, an inner conductor, and a dielectric spacer disposed between the outer conductor and the inner conductor;

wherein the outer conductor includes a first outer conductor component and a second outer conductor component configured to be floatable axially and radially relative to the first outer conductor component; and wherein the inner conductor includes a first inner conductor component and a second inner conductor component configured to be floatable axially and radially relative to the first inner conductor component.

2. The coaxial connector according to claim 1, characterized in that each of the first outer conductor component and the second outer conductor component is configured in a cylindrical shape and includes a proximal portion and a distal portion, wherein the distal portion of the first outer conductor component is configured to be inserted into the proximal portion of the second outer conductor component.

3. A coaxial connector, characterized in that the coaxial connector comprises an outer conductor, an inner conductor, and a dielectric spacer disposed between the outer conductor and the inner conductor:

wherein the outer conductor includes a first outer conductor component and a second outer conductor component configured to be floatable axially and radially relative to the first outer conductor component; and wherein the inner conductor includes a first inner conductor component and a second inner conductor component configured to be floatable axially and radially relative to the first inner conductor component;

wherein each of the first outer conductor component and the second outer conductor component is configured in a cylindrical shape and includes a proximal portion and a distal portion, wherein the distal portion of the first outer conductor component is configured to be inserted into the proximal portion of the second outer conductor component; and wherein an outer circumferential surface of the distal portion of the first outer conductor component includes a first protrusion protruding radially outwardly and being close to a distal end of the first outer conductor component, wherein when the distal portion of the first outer conductor component is inserted into the proximal portion of the second outer conductor component, the first protrusion abuts against an inner circumferential surface of the second outer conductor component, so as to form an electrical connection between the first outer conductor component and the second outer conductor component.

4. The coaxial connector according to claim 3, characterized in that the outer circumferential surface of the distal portion of the first outer conductor component further includes a second protrusion protruding radially outwardly and being axially spaced apart from the first protrusion by a distance; and an inner circumferential surface of the proximal portion of the second outer conductor component includes a third protrusion projecting radially inwardly and being close to a proximal end portion of the second outer conductor component, wherein when the distal portion of the first outer conductor component is inserted into the proximal portion of the second outer conductor component, the second protrusion passes over the third protrusion, so as to form a mechanical connection between the first outer conductor component and the second outer conductor component by means of an interference fit between the second protrusion and the third protrusion to ensure the first outer conductor component will not disconnect from the second outer conductor component.

5. The coaxial connector according to claim 3, characterized in that the distal portion of the first outer conductor component includes a plurality of resilient fingers spaced apart from each other, wherein the first protrusion is disposed on the resilient fingers.

6. The coaxial connector according to claim 4, characterized in that the distal portion of the first outer conductor component includes a plurality of resilient fingers spaced apart from one another, wherein the first protrusion and the second protrusion are both disposed on the resilient fingers.

7. The coaxial connector according to claim 4, characterized in that when the distal portion of the first outer conductor component is inserted into the proximal portion of the second outer conductor component, a gap is present between the second protrusion and the inner circumferential surface of the proximal portion of the second outer conductor component.

8. The coaxial connector according to claim 4, characterized in that each of the first protrusion, the second protrusion, and the third protrusion has an arc-shaped outer surface.

9. A coaxial connector, characterized in that the coaxial connector comprises an outer conductor, an inner conductor, and a dielectric spacer disposed between the outer conductor and the inner conductor;

wherein the outer conductor includes a first outer conductor component and a second outer conductor component configured to be floatable axially and radially relative to the first outer conductor component; and wherein the inner conductor includes a first inner conductor component and a second inner conductor component configured to be floatable axially and radially relative to the first inner conductor component;

wherein the coaxial connector further comprises a first elastic element disposed at least around an outer circumference of the proximal portion of the second outer conductor component, wherein in an initial state, the first elastic element spaces the first outer conductor component from the second outer conductor component at a predetermined distance, and in a compressed state, the first elastic element is capable of being compressed to allow the second outer conductor component to float axially relative to the first outer conductor component.

10. The coaxial connector according to claim 9, characterized in that the proximal portion of the first outer conductor component is provided with a first step portion, the distal portion of the second outer conductor component is provided with a second step portion, and the first elastic element is received in a recess formed by the first step portion and the second step portion.

11. The coaxial connector according to claim 9, characterized in that the first elastic element is a coil spring.

12. The coaxial connector according to claim 1, characterized in that the first inner conductor component is configured as an elongated element, and the second inner conductor component is configured to be fittable over an outer circumference of a distal portion of the first inner conductor component.

13. The coaxial connector according to claim 12, characterized in that the second inner conductor component includes a central body, and a first cylindrical portion and a second cylindrical portion extending axially from the central body towards a proximal side and a distal side respectively, wherein the first cylindrical portion is finable over the outer circumference of the distal portion of the first inner conductor component, and the second cylindrical portion is adapted for mating with an inner conductor of a mating connector.

14. The coaxial connector according to claim 13, characterized in that when the first cylindrical portion is fitted over the outer circumference of the distal portion of the first inner conductor component, a gap is present between the first cylindrical portion and the outer circumference of the distal portion of the first inner conductor component, so as to allow the second inner conductor component to float axially and radially relative to the first inner conductor component.

15. The coaxial connector according to claim 13, characterized in that the first inner conductor component and the second inner conductor component are connected to each other by means of a connecting element, wherein the connecting element is configured as an elongated element and includes a proximal portion and a distal portion, the proximal portion of the connecting element is slidably connected to the distal portion of the first inner conductor component, and the distal portion of the connecting element is fixed to the central body of the second inner conductor component.

16. The coaxial connector according to claim 15, characterized in that the distal portion of the connecting element is fixed to the central body of the second inner conductor component by means of press-fitting.

17. The coaxial connector according to claim 15, characterized in that the distal portion of the first inner conductor component includes a cavity that opens toward a distal end of the first inner conductor component, and the proximal portion of the connecting element is slidably received in the cavity.

18. A board-to-board connector assembly, characterized in that the board-to-board connector assembly comprises:

a first printed circuit hoard and a second printed circuit board disposed substantially parallel to each other;

at least one first coaxial connector mounted to the first printed circuit board, wherein the first coaxial connector is configured as the coaxial connector of claim 1; and at least one second coaxial connector mounted to the second printed circuit board, wherein the second coaxial connector is capable of mating with the first coaxial connector.

19. The board-to-board connector assembly according to claim 18, characterized in that the second coaxial connector includes an outer conductor, an inner conductor, and a dielectric spacer disposed between the outer conductor and the inner conductor of the second coaxial connector, wherein the outer conductor of the second coaxial connector has a cylindrical shape, and a proximal portion of the outer conductor of the second coaxial connector includes a tapered inner circumferential surface.

20. The board-to-hoard connector assembly according to claim 18, characterized in that the board-to-board connector assembly includes a plurality of first coaxial connectors and a plurality of second coaxial connectors, wherein the plurality of first coaxial connectors and the plurality of second coaxial connectors are disposed on the first printed circuit board and the second printed circuit board respectively in a same array.

* * * * *